United States Patent [19]

Infantino

[11] 4,241,554

[45] Dec. 30, 1980

[54] DECORATIVE SKIRTING PANEL SYSTEM

[75] Inventor: Dick S. Infantino, Cupertino, Calif.

[73] Assignee: Kool Foam Products, Inc., Santa Clara, Calif.

[21] Appl. No.: 940,059

[22] Filed: Sep. 6, 1978

Related U.S. Application Data

[63] Continuation-in-part of Ser. No. 824,675, Aug. 15, 1977, abandoned, which is a continuation of Ser. No. 656,487, Feb. 9, 1976, abandoned.

[51] Int. Cl.[2] ..... E04C 2/20

[52] U.S. Cl. ..... 52/314; 52/DIG. 3; 52/593; 52/309.1

[58] Field of Search ..... 52/309.1, 314, DIG. 3, 52/309.4, 593

[56] References Cited

U.S. PATENT DOCUMENTS

| | | | |
|---|---|---|---|
| 2,139,620 | 12/1938 | Kirschbraun | 52/314 |
| 3,882,218 | 5/1975 | Bixel | 52/314 |
| 3,899,855 | 8/1975 | Gadsby | 52/314 |
| 4,001,361 | 1/1977 | Unruh | 52/309.1 |

FOREIGN PATENT DOCUMENTS

| | | | |
|---|---|---|---|
| 937552 | 3/1948 | France | 52/405 |
| 301722 | 10/1932 | Italy | 52/314 |

*Primary Examiner*—James L. Ridgill, Jr.

*Attorney, Agent, or Firm*—Townsend and Townsend

[57] ABSTRACT

A decorative skirting panel system for mobile homes and the like is formed with adjacent panels having a vertically slidable side edge interlock wherein a particular panel may be easily removed for replacement, repair, or access without detachment of adjacent panels. The panel is preferably formed of expanded polystyrene foam and is provided with an exterior surface simulating masonry such as brick, stone, tile or other such construction material. The side edge interlock is of a V-shaped tongue-and-groove construction. This configuration provides a minimum surface area for a given width and depth of tongue and groove, thereby reducing friction and facilitating the removal or insertion of a panel by vertical sliding movement. The V-shaped tongue and groove is especially well suited to this application since it is not prone to binding in the case of dimensional inhomogeneities and the like. The foam from which the panels are constructed is of a sufficient density to provide smooth mating surfaces of the tongue and groove, thereby further facilitating the sliding movement.

5 Claims, 4 Drawing Figures

DECORATIVE SKIRTING PANEL SYSTEM

The present invention relates to building construction elements and is more particularly directed to a decorative facade panel for use as skirting, as for example in conjunction with mobile homes. This application is a continuation-in-part of Ser. No. 824,675, filed Aug. 15, 1977, now abandoned, itself a continuation of Ser. No. 656,487, filed Feb. 9, 1976 abandoned.

BACKGROUND OF THE INVENTION

Various forms of skirting panels are available to conceal the undercarriage of mobile homes and similar structures. These panels extend between the lower portion of the mobile home sidewall and the ground and are typically fabricated of metal or fiberglass and, more recently, expanded polystyrene foam. These panels are usually molded or otherwise formed with an exterior surface which simulates masonry such as brick, stone, tile or other construction material according to well known techniques in the art of molding metal and plastic.

Because of their placement and vulnerability such panels are often subjected to physical damage and in such event, the affected panel must be replaced or repaired. Existing panels of this general type have an interfitting or interlocking side edge configuration which makes replacement of a single skirting panel difficult and requires detachment of adjacent panels. In some cases, all panels along an entire sidewall of the mobile home must be disassembled to remove a single damaged panel.

SUMMARY OF THE INVENTION

The panels of the present invention incorporate a side edge interlock design which permits easy removal and reinstallation of a single panel from the mobile home without any interference with the placement of adjacent panels.

Each panel has uninterrupted vertical side edges extending substantially the entire height of the panel, with a V-shaped tongue extending the entire length of a first edge and a correspondingly configured V-shaped groove extending the entire length of a second side edge. The tongue of one panel engages the groove of an adjacent panel to maintain the panels in a coplanar relationship. This permits removal or insertion of a single panel to be accomplished without disturbing adjacent panels, by sliding the panel vertically. The V-shaped tongue and groove is especially well suited to vertical slidable engagement and disengagement for two reasons. First, for a given width and depth of groove (or tongue) necessary to maintain alignment between adjacent panels, the V-shaped configuration presents a minimum surface area of contact between a tongue and a mating groove, thereby reducing friction. Additionally, a V-shaped tongue and groove is not prone to binding, as for example if one of the panels is slightly misshapen or warped.

The foam from which the panels is fabricated is preferably of a density above 2 lbs. per cubic foot with a density of 2.5 lbs. per cubic foot providing optimum strength and light weight. The foam density is sufficient to present a smooth exterior surface, particularly on the tongue and groove. This further facilitates vertical slidable disengagement since the tongue and groove have smooth mating surfaces.

Other objects, features and advantages of the present invention will become more apparent after reading the following detailed description with reference to the accompanying drawings.

DETAILED DESCRIPTION OF THE INVENTION

Figure 1:
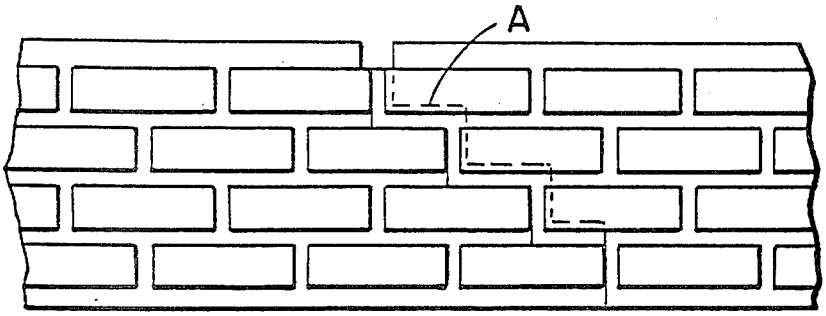
FIG 1 (PRIOR ART)
FIG. 1 illustrates a skirting panel construction according to the prior art wherein mating side edges of adjacent panels are provided with an interfitting stepped profile.
Figure 2:
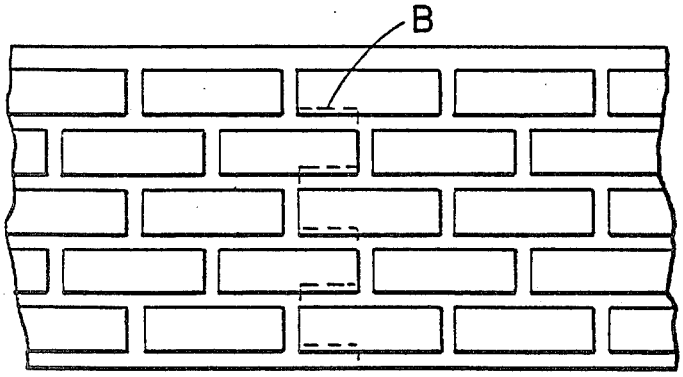
FIG 2 (PRIOR ART)
FIG. 2 illustrates a skirting panel according to the prior art wherein mating side edges of adjacent panels are provided with an interleaved profile.

Referring to the drawings, FIGS. 1 and 2 illustrate two types of skirting panels according to the prior art. FIG. 1 depicts a panel having conformably shaped side edges of stepped profile which matingly engage corresponding side edges of adjacent panels while FIG. 2 illustrates a panel design involving interleaved side edges with complementary recesses and projections in alternate rows. Typically, the top edge of such panels is attached to the lower periphery of the mobile home sidewall while the bottom edge is in some way fixed to the ground. The type of panel illustrated in FIG. 1 is shown in more detail in U.S. Pat. No. 3,613,326 issued Oct. 19, 1971 to Hollman and the construction of FIG. 2 is more fully described in U.S. Pat. No. 3,921,357 issued Nov. 25, 1975 to Unruh. Both types of construction utilize a tongue and groove interlock.

The stepped and interleaved shapes of the illustrated prior art panels result primarily from an attempt to conceal the vertical joint between adjacent panels. This is achieved by staggering alternate rows of simulated bricks and forming the edge profile to coincide with the horizontal and vertical outlines of individual bricks.

Because of this configuration, the tongue and groove interlock extends along both horizontal and vertical surfaces of the side edges. This requires that adjacent panels can only be separated by sliding them apart in a horizontal direction in the plane of the panels. A single panel cannot be easily removed either vertically in the plane of the assembled panels or horizontally in a direction transverse to the plane of the panels. The net result is that if a particular panel is damaged, it can be removed for repair or replacement only after detachment of adjacent panels.

Figure 3:
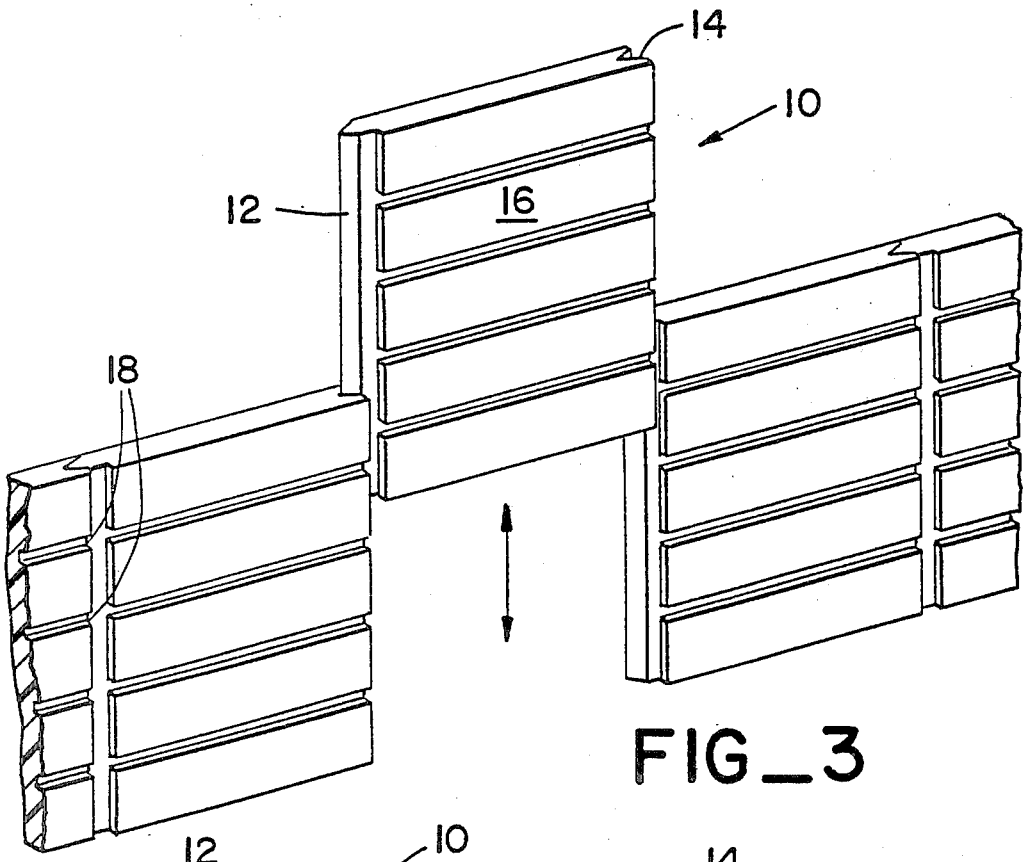
FIG. 3 is a perspective view of a system of adjacent skirting panels according to the present invention illustrating the manner in which a single panel is removed.
Figure 4:
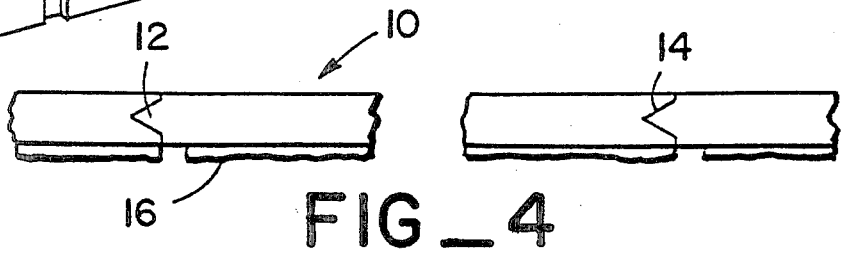
FIG. 4 is a top view of the building panels of FIG. 3 illustrating in greater detail the tongue and groove interlock.

Referring to FIGS. 3 and 4, a system incorporating the building panels of the present invention can be seen. A mobile home sidewall 5 is supported above the ground and has an exterior surface with a lower portion 7. The system comprises a plurality of panels 10 which overlie and are held to lower sidewall portion 7 by any suitable means, panels 10 of the system extending downwardly to the ground. Panel 10 may be constructed of metal or fiberglass but it is preferably formed of foamed plastic such as expanded polystyrene as shown in U.S. Pat. No. 3,882,218 issued May 6, 1975 to Bixel. It has been found that when the foam density of such polystyrene panels is below about 2 pounds per cubic foot, the panels are susceptible to undue physical damage as a result of the type of impact normally encountered in exterior sidewall skirting. Accordingly, the preferred density is above 2 pounds per cubic foot while a density of 2.5 pounds per cubic foot has been found to provide the optimum combination of strength and light weight. This provides panels which are resilient enough to absorb shock, but rigid enough to remain in alignment with one another. Also according to the preferred embodiment the panels are provided with a protective coating, such as fire retardant paint, of a color which enhances the masonry simulating effect of the exterior surface.

Panel 10 is provided with a V-shaped projection or tongue 12 which extends vertically along one side edge and a conformably shaped recess or groove 14 which extends vertically along the opposite side edge. The panel front face 16 is formed with a number of projections simulating an array of bricks arranged in rows with their side edges in vertical alignment. Various other decorative surfaces may be used to simulate masonry materials other than brick, such as slump stone, flag stone, tile, and the like.

It will be seen that in case a particular panel, such as panel 10, is physically damaged it may be easily removed for repair or replacement. Since the interlinked assembly of panels are attached to the mobile home sidewall exterior of the sidewall surface, this is accomplished by merely detaching the top of the panel from the mobile home sidewall and the bottom of the panel from the ground and sliding the panel upwardly in a vertical direction until it is clear of the adjacent panels. Such removal may be useful for other purposes such as to gain access to the undercarriage of the mobile home. Replacement is carried out by reversing the above process.

The V-shaped tongue and groove has been found to be especially well-adapted to the feature of the present invention which allows a panel to be removed or inserted by sliding the panel vertically. First, for a given depth and width of tongue and groove necessary to maintain adjacent panels in a coplanar relationship, the V-shaped configuration presents a smaller surface area in contact than a correspondingly dimensioned U-shaped tongue and groove. A symmetric V-shaped tongue and groove as illustrated provides the minimum surface area in contact. Additionally, a V-shaped tongue and groove is not prone to binding in the event that adjacent panels do not precisely mate. For example, if groove 14 were of a somewhat sharper angle than tongue 12, there would be no binding. Rather, tongue 12 would extend into groove 14 only so far as the maximum width of groove 14 would permit without any potential for binding. Further, should one of the panels be slightly warped, the tongue and groove would mate insofar as possible, without any possibility of the tongue being captured in the groove to impede vertical slidability.

The preferred density of the foam, in addition to providing needed strength as discussed above, further enhances the vertical slidability of individual panels. The preferred density is sufficiently high that the panels have a smooth exterior, particularly on the mating surfaces of tongue 12 and groove 14. This reduces the friction between adjacent panels so that an individual panel may be easily removed or inserted by sliding it vertically.

It should be noted that the panel construction of the present invention provides minimum visibility of the interpanel joint since the break line corresponds along most of its length with the side edges of the simulated bricks or stones, the only undisguised portion of the break extending through the simulated mortar lines between the bricks as at 18.

While the embodiment of the skirting panel of the present invention has been shown and described above, it will be apparent that various modifications of the specific example disclosed can be made without departing from the spirit and scope of the invention as defined by the appended claims. For example, the panel of the present invention is not limited to use in connection with mobile homes and is useful in any application involving building wall skirting with unobstructed vertical clearance for sliding removal and insertion. This would include both interior and exterior walls of a wide variety of structures.

What is claimed is:

1. In a decorative skirting system for installation along a side of a mobile home which is supported above the ground, the skirting system adapted to overlie and be held to the exterior surface of the lower portion of the mobile home sidewall and extend downwardly therefrom to the ground, the system comprising a generally coplanar plurality of panels of expanded polystyrene foam, each panel being formed with an array of rectangular projections stimulating masonry material, the improvement wherein:

each panel has uninterrupted first and second vertical side edges extending to the ground, with a V-shaped tongue extending the entire length of the first side edge, and a correspondingly configured V-shaped groove extending the entire length of the second side edge, the tongue of one panel engaging the groove of an adjacent panel to maintain the panels in a coplanar relationship, the V-shaped tongue and groove having a common specified width and depth necessary to maintain the coplanar relationship, the uninterrupted vertical side edges permitting an individual panel to be slidably disengaged from adjacent panels without disturbing the adjacent panels by detaching the top of the panel from the mobile home sidewall and sliding the panel vertically upward a distance at least that of the height of the panel, the V-shaped configuration of the tongue and groove providing a minimum surface area between an engaged tongue and groove for the specified width and depth and preventing binding arising from dimensional inhomogeneities, thereby facilitating the slidable disengagement; and the rectangular projections are aligned in vertical columns with simulated mortar lines therebetween, such that the boundary between adjacent panels falls within a simulated mortar line and is thereby disguised.

2. The invention of claim 1 wherein the foam has a sufficient density to provide a substantially smooth surface on the V-shaped tongue and groove.

3. The invention of claim 2 wherein the foam has a density of about 2.5 pounds per cubic foot.

4. In a decorative skirting system for installation along a side of a mobile home which is supported above the ground, the skirting system adapted to be held to the lower portion of the mobile home and extend downwardly therefrom to the ground, the system comprising a generally coplanar plurality of panels of expanded polystyrene foam, each panel being formed with an array to rectangular projections simulating masonry material, the improvement wherein:

each panel has uninterrupted first and second vertical side edges extending substantially the entire height thereof, the first edge having a V-shaped tongue, and the second edge having a correspondingly configured V-shaped groove, the tongue of one panel engaging the groove of an adjacent panel to maintain the panels in a coplanar relationship, the V-shaped tongue and groove having a common specified width and depth necessary to maintain the coplanar relationship, with the V-shaped configuration of the tongue-and-groove providing a minimum surface area in contact between an engaged tongue and groove for the specified width and depth;

the rectangular projections are aligned in vertical columns with simulated mortar lines therebetween, the boundary between adjacent panels falling within a simulated mortar line and being thereby disguised; and the foam is of a sufficient density that the surface of the V-shaped tongue and groove is substantially smooth;

the individual vertical side edges permitting an individual panel to be slidably disengaged from adjacent panels by sliding the panel vertically upward a distance at least that of the panel height with the vertical slidable disengagement being facilitated by the minimum surface area between engaged tongue and groove and the smooth surface area provided by the foam density.

5. The invention of claim 4 wherein the foam has a density greater than 2 pounds per cubic foot.

* * * * *